US011441246B2

(12) United States Patent
Hozumi

(10) Patent No.: US 11,441,246 B2
(45) Date of Patent: Sep. 13, 2022

(54) TOWEL PRODUCT

(71) Applicant: UCHINO CO., LTD., Chuo-ku (JP)

(72) Inventor: Shuichi Hozumi, Chuo-ku (JP)

(73) Assignee: UCHINO CO., LTD., Tokyo (JP)

( * ) Notice: Subject to any disclaimer, the term of this patent is extended or adjusted under 35 U.S.C. 154(b) by 0 days.

(21) Appl. No.: 16/018,800

(22) Filed: Jun. 26, 2018

(65) Prior Publication Data

US 2018/0298528 A1 Oct. 18, 2018

Related U.S. Application Data

(63) Continuation-in-part of application No. 14/894,145, filed as application No. PCT/JP2014/059562 on Mar. 31, 2014, now abandoned.

(30) Foreign Application Priority Data

May 28, 2013 (JP) ..... 2013-112299

(51) Int. Cl.
*D03D 13/00* (2006.01)
*D03D 1/00* (2006.01)
(Continued)

(52) U.S. Cl.
CPC ..... *D03D 13/004* (2013.01); *A47K 10/02* (2013.01); *D03D 1/0017* (2013.01); *D03D 15/44* (2021.01);
(Continued)

(58) Field of Classification Search
None
See application file for complete search history.

(56) References Cited

U.S. PATENT DOCUMENTS 7,810,308 B2 10/2010 Wnag
8,733,075 B2 5/2014 Mandawewala
(Continued)

FOREIGN PATENT DOCUMENTS

CN 2250363 3/1997
CN 1517037 A 8/2004
(Continued)

OTHER PUBLICATIONS

Machine translation of CN 101949097, Jinxin et al. (Year: 2011).*
(Continued)

*Primary Examiner* — Shawn Mckinnon
(74) *Attorney, Agent, or Firm* — Masuvalley & Partners; Peter R. Martinez

(57) ABSTRACT

To provide a towel product capable of maintaining features of honeycomb weave of the conventional technique as well as providing improved water absorbency, lightness, and a good touch feeling more than those of the towels produced by the conventional technique. The towel of the present invention basically has a typical honeycomb weave structure. A first feature thereof is to use hollow yarns having a hollow ratio of a range between 30% and 60%. A shape of hollow yarns can be maintained. With the above described structure, the water absorbency, the lightness, the good touch feeling, and a drying property can be improved. A second feature is to use hollow yarns made by twisting fibers of raw cottons having an effective fiber length of a range between 25 mm and 42 mm. This contributes to maintaining of the durability.

8 Claims, 10 Drawing Sheets

Surface
Back

(51) Int. Cl.

| | |
|---|---|
| ***D03D 15/00*** | (2021.01) |
| ***A47K 10/02*** | (2006.01) |
| ***D03D 15/44*** | (2021.01) |
| ***D03D 15/567*** | (2021.01) |

(52) U.S. Cl.
CPC ..... *D03D 15/567* (2021.01); *D10B 2201/02* (2013.01); *D10B 2403/033* (2013.01); *D10B 2503/00* (2013.01)

(56) References Cited

U.S. PATENT DOCUMENTS

| | | | | |
|---|---|---|---|---|
| 2004/0170836 | A1* | 9/2004 | Bond | D01D 5/24 428/398 |
| 2005/0202741 | A1* | 9/2005 | Onodera | D03D 15/49 442/194 |
| 2007/0087162 | A1 | 4/2007 | Mandawewala | |
| 2009/0025818 | A1 | 1/2009 | Hozumi | |
| 2016/0102422 | A1* | 4/2016 | Hozumi | D03D 15/00 442/194 |
| 2019/0257011 | A1 | 8/2019 | Goenka et al. | |

FOREIGN PATENT DOCUMENTS

| | | | | |
|---|---|---|---|---|
| CN | 101165246 | | | 4/2008 |
| CN | 101949097 | | * | 1/2011 |
| CN | 204016200 | U | | 12/2014 |
| JP | H05-272026 | | | 10/1993 |
| JP | H07-97745 | | | 4/1995 |
| JP | 9-117388 | A | | 5/1997 |
| JP | H093-02545 | | | 11/1997 |
| JP | H09302545 | | * | 11/1997 |
| JP | 11-81120 | A | | 3/1999 |
| JP | 2002285442 | | * | 10/2002 |
| JP | 2003-73970 | A | | 3/2003 |
| JP | 2005-232645 | A | | 9/2005 |
| JP | 2007-177373 | A | | 7/2007 |
| JP | 2007/100077 | A1 | | 9/2007 |
| JP | 2009-160212 | A | | 7/2009 |
| TW | 232808 | A | | 10/1994 |
| TW | M374839 | U1 | | 3/2010 |
| TW | 525707 | U | | 7/2016 |

OTHER PUBLICATIONS

Machine translation of JP2002285442 (Year: 2002).*
Machine translation of JPH09302545 (Year: 1997).*
Taiwan Office Action dated Oct. 15, 2018 in corresponding Taiwan Application No. 104108577 (with English Translation of Category of Cited Documents), citing documents AO-AQ therein, 6 pages.
International Search Report dated Jul. 1, 2014 in PCT/JP2014/059562 filed Mar. 31, 2014.
"India Cotton and Textile Industries," Allied Publishers, 1999, pp. 161.
Merati et al., Textile Research Journal, "Hollow Yarn in Friction Spinning, Part I: Tensile Properties of Hollow Yarn," vol. 70, issue 12, pp. 1070-1076, Dec. 2000.
Extended European Search Report dated Mar. 7, 2017 in European Patent Application No. 14804000.9.
Notice of Allowance dated Aug. 19, 2015, in Japanese Patent Application No. 2015-519721 (with English-language translation).
Taiwan Office Action issued in Taiwan Patent Application No. 104108577 dated Sep. 12, 2019, citing references AO-AP therein.
Jitendra Pratap Singh et al., "Woven Terry Fabrics: Manufacturing and Quality Management" A volume in Woodhead Publishing Series in Textiles, 2017, p. 32.
Jitendra Pratap Singh et al., "Woven Terry Fabrics: Manufacturing and Quality Management" A volume in Woodhead Publishing Series in Textiles, 2017, p. 33.
Jitendra Pratap Singh et al., "Woven Terry Fabrics: Manufacturing and Quality Management" A volume in Woodhead Publishing Series in Textiles, 2017, p. 34.
Jitendra Pratap Singh et al., "Woven Terry Fabrics: Manufacturing and Quality Management" A volume in Woodhead Publishing Series in Textiles, 2017, p. 35.
Daigo Maejima, "Fanciful Hollow Yarn" mailed on Feb. 10, 2021.

* cited by examiner comparative example comparative example comparative example

Background art

Background art

TOWEL PRODUCT

CROSS-REFERENCE TO RELATED APPLICATIONS

This patent application is a continuation-in-part of U.S. application Ser. No. 14/894,145, filed Nov. 25, 2015, which is a U.S. national stage application of International Application No. PCT/JP14/59562, filed Mar. 31, 2014 and the entire contents of which are incorporated herein by reference, which claims priority to JP 2013-112299, filed May 28, 2013 and the entire contents of which are incorporated herein by reference.

TECHNICAL FIELD

The present invention relates to a towel product having a honeycomb weave structure.

BACKGROUND ART

Honeycomb weave towel products have been widely used mainly in Europe as a birthplace thereof. Recently, the honeycomb weave towel products are used also in Japan. For example, the honeycomb weave towel products are used widely in many fields such as towels, bath towels, and gowns, e.g., towel-made robes, in addition to kitchen dishcloths. The honeycomb weave is sometimes referred to as a waffle fabric since it has a texture similar to Waffles (see, patent literature 1).

Unlike a typical towel having loop piles on its surface, a honeycomb weave towel has a woven fabric structure obtained by deforming a plain weave which is woven in a manner that a single warp yarn is crossed over a single weft yarn to continue weaving in this manner. Thus deformed woven fabric is characterized by having a concave-convex surface generated by shrinkage of fabric itself. This structure can provide the following advantageous effects.

For example, when one wipes off his sweat, he presses a towel against his skin softly. At the time, only convex parts of the towel touch his skin to absorb moisture. The moisture absorbed by the convex parts is partially evaporated and partially transferred to concave parts of the towel. As a result thereof, the convex parts can always keep a dry state.

With the above feature, the user of the towel can be provided with a dry touch feeling every time when the user repeats to wipe off his sweat. In other words, no stickiness remains in the towel after the use thereof. Equivalent effect can be produced when the above described feature is applied to a bath mat to be used in a bath room.

Further, the honeycomb weave towel is thinner than a towel having loop piles on its surface. Therefore, the honeycomb weave towel is compact. Still further, in the honeycomb weave towel, loosening of pile yarns hardly occurs and fluff comes out only a little.

CITATION LIST

Patent Literature

[PATENT LITERATURE 1] Japanese Unexamined Patent Application, First Publication No. 2009-160212

SUMMARY OF INVENTION

Technical Problem

However, in different perspectives, the above described feature of the honeycomb weave towel product may raise another problem.

Generally, it is preferable for towel products to have a well-balanced performance between water absorbency, a drying property, lightness, and a good touch feeling. For example, towels are frequently used in order to wipe off wet body after bathing, and thus the water absorbency is a performance essential for towels. Towels are used every day. Also, towels are used by people of all ages from children to the elderly. Therefore, it is preferable to achieve weight reduction. Since a towel directly touches a human skin, and thus its touch feeling affects on a comfort level of the user. Rough touch feeling and hard touch feeling make the user uncomfortable. Further, indoor drying for a long time invites growth of bacteria and generation of unpleasant smell. Drying with a drying machine for a long time invites waste of energy.

On the other hand, the conventional honeycomb weave towel has the following problem with respect to the water absorbency, the lightness, and the good touch feeling.

When wiping off moisture, one presses a towel against his skin softly. At the time, only convex parts touch his skin. In other words, a touch area is small. As a result thereof, satisfactory water absorbency cannot be realized.

Weaving densely achieved by using thick yarns improves the water absorbency. However, this leads to a heavy weight and a hard touch feeling.

Further, in the honeycomb weave towel, a densely woven structure is further shrunk to generate concaves and convexes on its surface. Therefore, weight per area becomes relatively large. More specifically, the honeycomb weave towel degrades in lightness for its compact appearance.

With the use of thin ordinary yarns, the lightness improves. However, since the thin ordinary yarns have a little shrinkage ratio, it is impossible for the thin ordinary yarns to make a large concave-convex surface in a fabric. In other words, it is difficult to feel a three-dimensional appearance of the honeycomb weave. Further, the water absorbency degrades.

Still further, the honeycomb weave towel provides a bounce feeling by the concave-convex surface. However, in comparison with the towel with loop piles, the honeycomb weave towel has less soft touch feeling. Specifically, the touch feeling touched by the convex parts is hard.

A combination of the ordinary yarns made by less number of twisting and a loosely woven structure improves a soft touch feeling. However, both of the ordinary yarns made by less number of twisting and the loosely woven structure have a little shrinkage ratio. Thus, it is impossible to make a large concave-convex surface in the fabric. This makes it difficult to provide a feeling of three-dimensional appearance of the honeycomb weave. Further, the water absorbency degrades.

As described above, the conventional honeycomb weave towel has problem with respect to the water absorbency, the lightness, and the good touch feeling. Improvement of any one of the above listed performances degrades other performances. More specifically, it is difficult to improve all of the water absorbency, the lightness, and the good touch feeling at the same time.

The present invention is made to solve the above described problem. The present invention is directed to provide a towel product capable of maintaining features of honeycomb weave produced by the conventional technique as well as improving the water absorbency, the lightness, and the good touch feeling more than the towel products produced by the conventional technique.

Solution to Problem

In order to solve the above described problem, the towel product of the present invention has a honeycomb weave structure and is woven by hollow yarns.

In the honeycomb weave structure, warp yarns and weft yarns are shrunk. Therefore, mutual binding becomes loose. This ensures that hollow portions are not crushed remarkably even with the use of hollow yarns. In other words, shapes of hollow yarns can be kept.

With the above described structure, the water absorbency, the lightness, the good touch feeling, and the drying property can be improved more than the towel products produced by the conventional technique.

Preferably, the hollow yarns have a hollow ratio of a range between 30% and 60%.

With the above range of hollow ratio, a person can actually feel, specifically, improved lightness.

Further preferably, the hollow yarns have a hollow ratio of a range between 40% and 50%.

With the above range of hollow ratio, more specific effects can be produced, and a concern about maintaining of shapes of hollow yarns can be eliminated.

Preferably, the hollow yarns are made by twisting fibers of raw cottons having an effective fiber length of a range between 25 mm and 42 mm.

Since the hollow yarns have a small cross sectional area, strength in an axis direction of the hollow yarns needs to be checked. That is, the hollow yarns have a problem in durability.

With the above described structure, it is possible to prevent the durability from being degraded.

Further preferably, the hollow yarns are made by twisting fibers of raw cottons having an effective fiber length of a range between 25 mm and 37 mm.

As a result, satisfactory durability can be produced as well as requirements of economic efficiency and practicality can be satisfied.

Advantageous Effect of Invention

According to the present invention, features of a honeycomb weave produced by the conventional technique can be maintained as well as water absorbency, lightness, and a good touch feeling can be improved more than the honeycomb weave produced by the conventional technique.

DESCRIPTION OF EMBODIMENTS

—Basic Structure—

Figure 1:
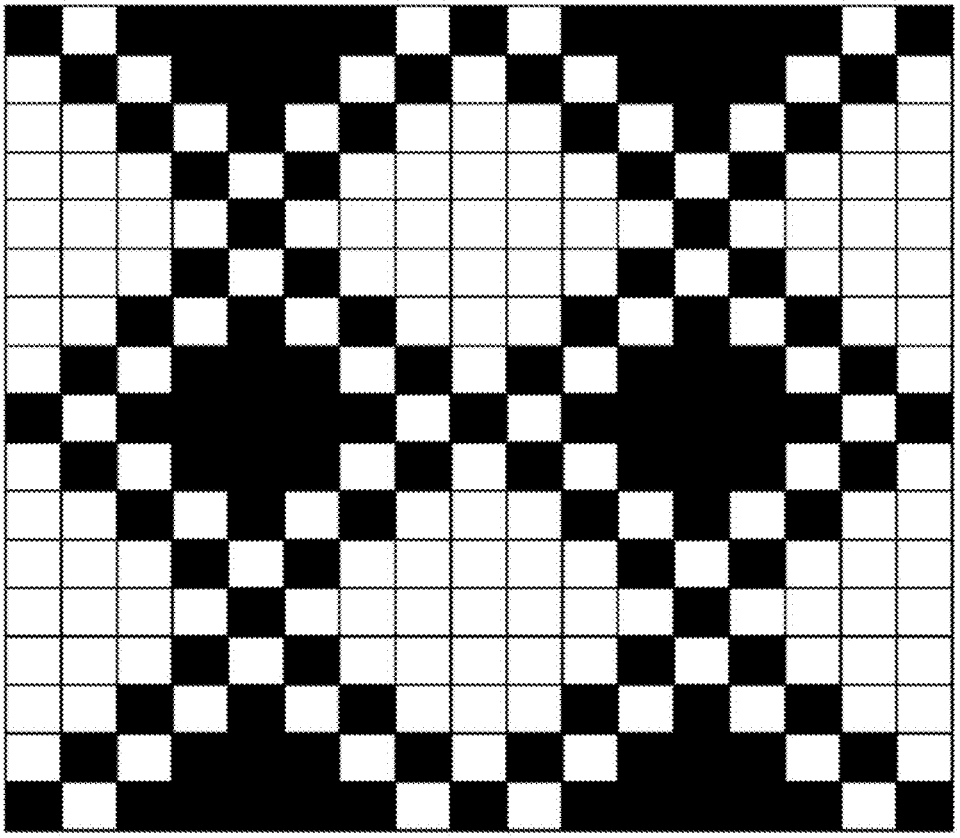
FIG. 1 is a schematic structural view of a honeycomb weave structure.
Figure 1:
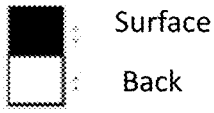

An embodiment of the present invention will be described below. FIG. 1 illustrates a structural view of a honeycomb weave structure. A honeycomb weave structure of the present embodiment is similar to a typical honeycomb weave structure. The honeycomb weave structure is a woven fabric structure obtained by deforming a plain weave which is woven in a manner that a single warp yarn is crossed over a single weft yarn to continue weaving in this manner. The honeycomb weave structure is characterized in having a concave-convex surface obtained by shrinking a fabric itself. More detailed descriptions thereof will be omitted here.

—Featured Structure 1—

It is a feature of the present embodiment to employ hollow yarns having a hollow ratio of a range between 30% and 60%.

Meanwhile, in a case where the hollow ratio is less than 30%, satisfactory effects as mentioned below cannot be produced. For example, in a case where the hollow ratio is less than 30%, a weight of product decreases by less than 20%. This fails to make a person feel improvement of lightness. On the other hand, in a case where the hollow ratio is equal to or more than 30%, a weight of product decreases by more than 20%. This ensures to make a person feel substantial effects such as improvement of lightness.

According to a search performed by the present inventor, almost all the persons could feel difference in lightness between the honeycomb weave towel woven by using the ordinary yarns (non-hollow yarn) and the 20% weight-decreased honeycomb weave towel (using the hollow yarn).

In a case where the hollow ratio is beyond 60%, a hollow yarn itself cannot maintain its shape. More specifically, the hollow ratio of 60% is an upper limit of practically usable hollow yarns.

Further, a preferable hollow ratio is a range between 40% and 50%. This range produces more pleasant effect as well as eliminates a concern about maintaining of a shape of hollow yarns. Hollow ratio of more than 42% is more preferable.

—Advantageous Effects—

In the honeycomb weave structure, warp yarns and weft yarns are caused to be shrunk, and thus mutual binding is loose. Therefore, the hollow structure would not be crushed remarkably even when the hollow yarns having a hollow ratio of a range between 30% and 60% are used. In other words, shape of the hollow yarns can be maintained. Further, descriptions will be made below as to water absorbency, lightness, a good touch feeling, and a drying property.

For example, with the use of hollow yarns having a hollow ratio of 50%, weight of the resulting product will be decreased by more than 30%. Therefore, one can actually feel improvement of lightness.

Meanwhile, with the use of hollow yarns having the hollow ratio of 50%, the hollow structure is slightly crushed and deformed. This decreases bulkiness of towel in comparison with a towel woven by using the ordinary yarns (non-hollow yarn). In order to keep the bulkiness of the towel at a level equivalent to the bulkiness of the towel woven by the ordinary yarns, it is necessary to weave the towel with a higher structural density (i.e., to weave the towel with the more number of yarns). As a result thereof, it becomes impossible to decrease the weight of towel by 50% even with the use of the hollow yarns having the hollow ratio of 50%.

When wiping off a small amount of moisture such as sweat, one presses a towel against his skin softly. At the time, only convex parts touch his skin. If the amount of moisture is small, the moisture can be absorbed only with the convex parts.

When one wipes off his wet body after bathing, one presses the towel against his body to cause the towel to closely touch his skin. The hollow yarns having the hollow ratio of the range between 30% and 60% has highly improved flexibility and pliability in comparison with those of the ordinary yarns. As a result thereof, the concave parts also come to touch his skin in addition to the convex parts. In other words, a touch area increases to provide him with satisfactory water absorbency.

A hollow yarn having the hollow ratio of the range between 30% and 60% has remarkably improved flexibility and pliability in comparison with those of the ordinary yarns. This can provide a soft good touch feeling of a towel itself.

Further, the use of hollow yarns having the hollow ratio of the range between 30% and 60% facilitates quick drying.

As described above, the lightness, the water absorbency, the good touch feeling, and the drying property can be improved more than those of a towel produced by the conventional technique.

On the other hand, even with the use of the hollow yarns having the hollow ratio of the range between 30% and 60%, features of the honeycomb weave of the conventional technique can be maintained.

—Newly Arising Problem—

However, in a case where a towel is woven only with hollow yarns having a specially large hollow ratio, e.g., hollow ratio of the range between 30% and 60%, the resulting towel is weak in strength as a fabric and, therefore, would be damaged largely by washing thereof. Therefore, such towel lacked in value (durability) as an item for sale. Therefore, it was essential to study how to weave a towel when weaving the towel using hollow yarns.

Meanwhile, as a result of various experiments, the inventor confirmed that the hollow structure would not be crushed remarkably if hollow yarns had the hollow ratio of a value equal to or less than 60% (see, the above description). More specifically, there is no problem in strength in a cross sectional direction of the hollow yarns. Next, it becomes necessary to study about strength in an axis direction of the hollow yarns.

—Featured Structure 2—

The hollow yarns of the present embodiment are characterized in that fibers of raw cottons having an effective fiber length of a range between 25 mm and 42 mm are twisted.

When raw cottons are decomposed, fibers of various lengths can be obtained. Generally, longer fiber cottons can provide yarns having only a small number of junctions when they are formed into yarns. This can provide increased strength.

Generally, in manufacturing a towel, fibers of raw cottons having an effective fiber length of a range between 20 mm and 25 mm are mixed, and cotton yarns having an average value of the effective fiber length of a range between 22 mm and 23 mm are used.

To the contrary, in a case where hollow yarns are made by twisting fibers of raw cottons having an effective fiber length less than 25 mm, satisfactory strength cannot be obtained. However, in a case where hollow yarns are made by twisting fibers of raw cottons having an effective fiber length equal to or more than 25 mm, practically durable strength can be obtained.

An effective fiber length of 42 mm is an upper limit of a fiber length of typical raw cottons. No fiber having a length beyond 42 mm can be obtained although there are differences in fiber length between raw cottons.

Further, a preferable effective fiber length is of a range between 25 mm and 37 mm. Fibers having the effective fiber length of 42 mm can be obtained only from limitative specific kinds of raw cottons. Therefore, gathering fibers having the effective fiber length of 42 mm is difficult in the light of economic efficiency and practicality. Under the circumstances, fibers of raw cottons having the effective fiber length of the range between 25 mm and 37 mm are distributed in markets for the use of luxury garments and beddings. Use of the distributing raw cottons for the sake of towels satisfies requirements of both of the economic efficiency and practicality.

—Advantageous Effects—

Use of the hollow yarns made by twisting fibers of raw cottons having the effective fiber length of a range between 25 mm and 42 mm ensures obtainment of satisfactory strength in its axis direction. As a result thereof, it becomes possible to obtain durability for repetitive washing.

Figure 2:
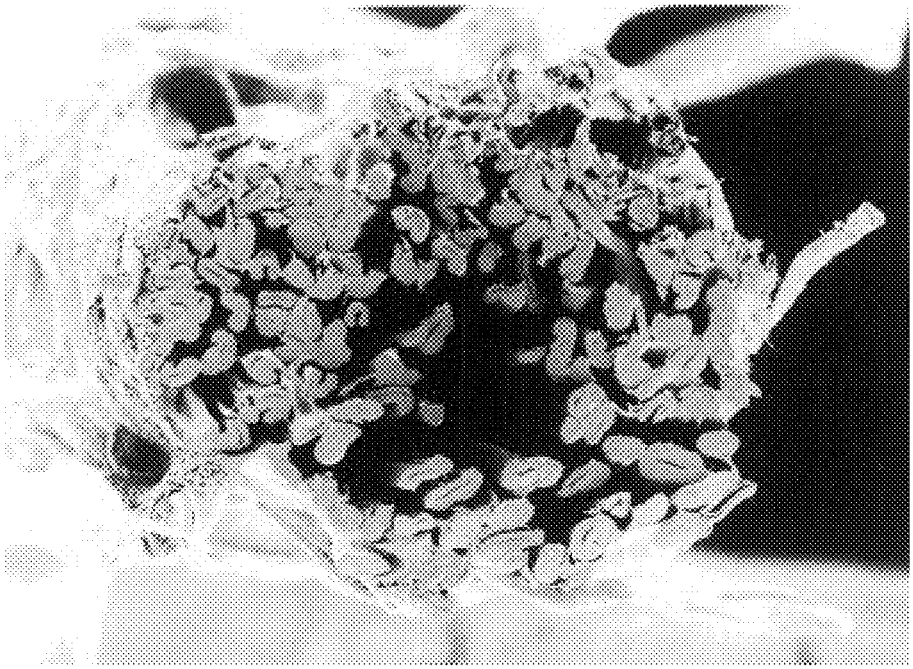
FIG. 2 is a cross-sectional photograph of a hollow cotton yarn, having a hollow ratio of 20%.

For achieving the present invention, the inventor studied about the use of hollow yarns having a hollow ratio of 20% for producing a honeycomb weave towel. It is noted that, for the following reasons, hollow yarns having the hollow ratio of about 20% are generally used for various towels in order to achieve weight saving thereof. FIG. 2 is a cross-sectional photograph of a hollow cotton yarn, having a hollow ratio of 20%.

When hollow yarns having the hollow ratio of 20% are used, a hollow structure is somewhat crushed to be deformed. Therefore, bulkiness decreases in comparison with towels woven by the ordinary yarns. In order to maintain the bulkiness equivalent to the bulkiness of the towel woven by the ordinary yarns, it is necessary to weave the towel with high structural density (with the increased number of yarns). As a result thereof, even with the hollow yarns having the hollow ratio of 20%, the weight could be decreased by only from 10% to 15%.

Satisfied improvement in lightness could not be actually felt from the decrease of weight by 10%. More specifically, decrease of weight by 10% does not meet an actual feeling of decrease of weight by 10%.

According to a research performed by the inventor, only a small number of persons could feel a difference in lightness between a honeycomb weave towel woven by the ordinary yarns and a honeycomb weave towel of which weight is decreased by 10%.

Figure 3:
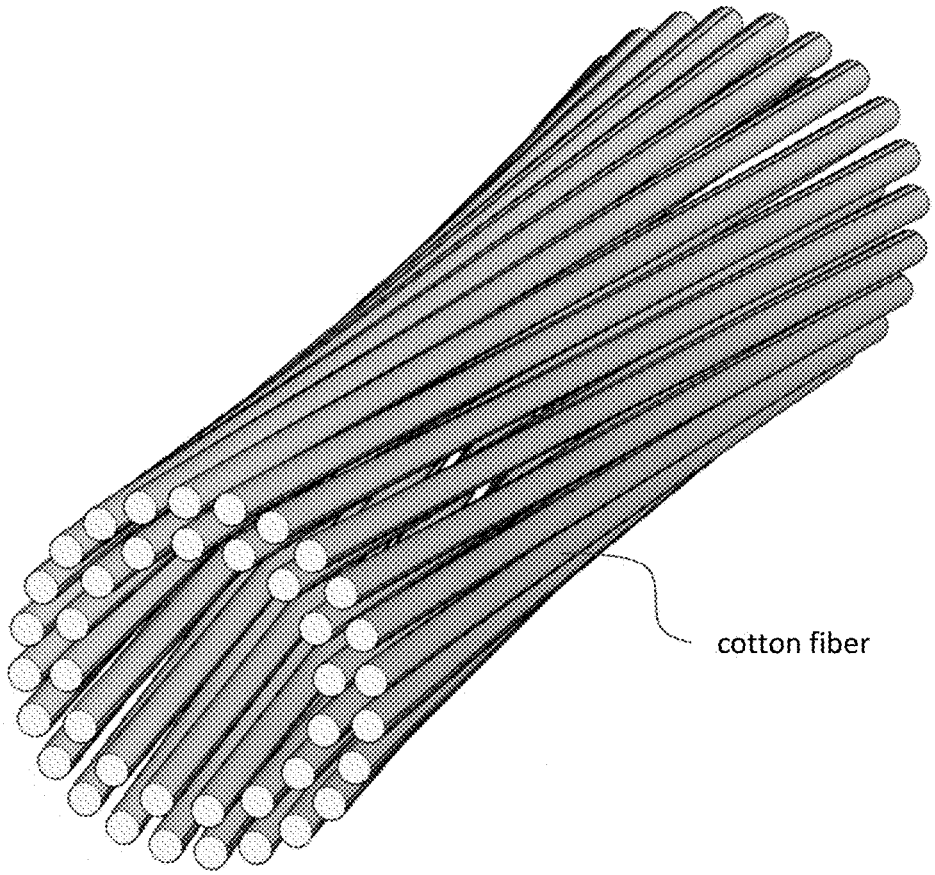
FIG. 3 is a schematic structural view of a hollow cotton yarn, having a hollow ratio of 50%.
Figure 4:
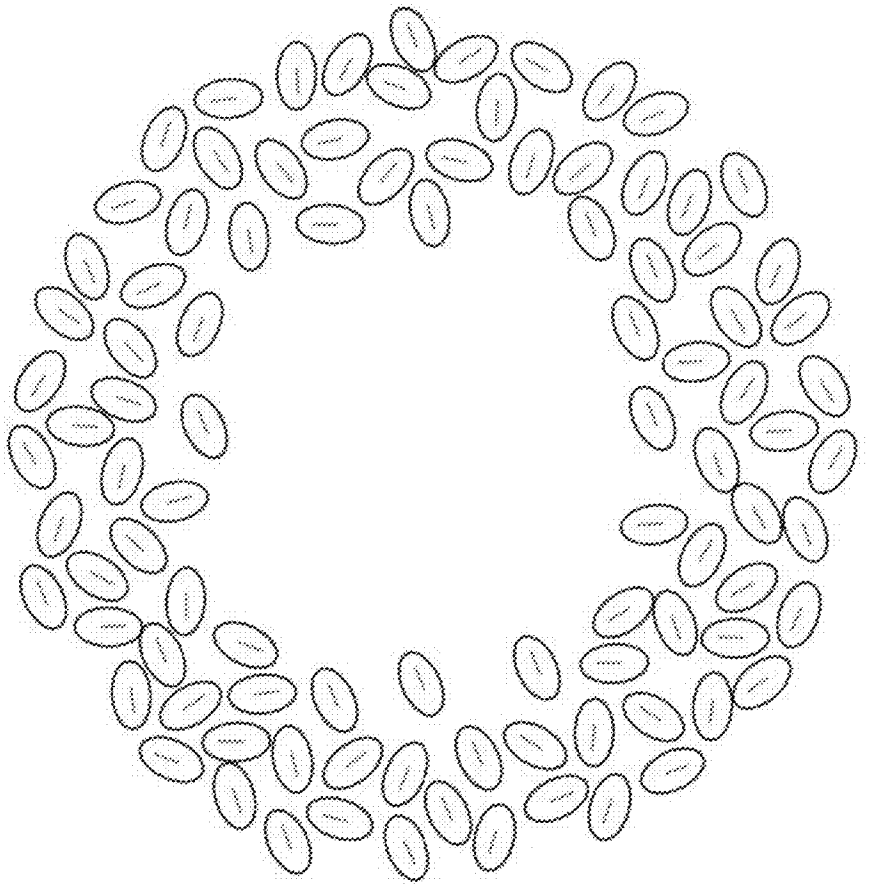
FIG. 4 is a cross-sectional view of a hollow cotton yarn, having a hollow ratio of 50%.
Figure 5:
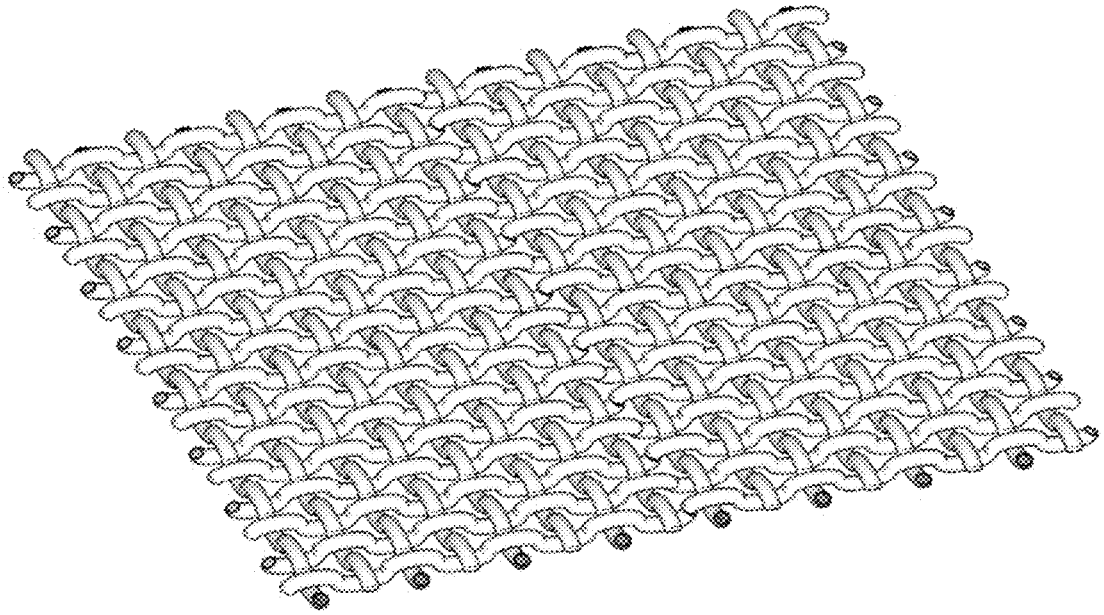
FIG. 5 is an overview appearance of a plain weave structure.
Figure 6:
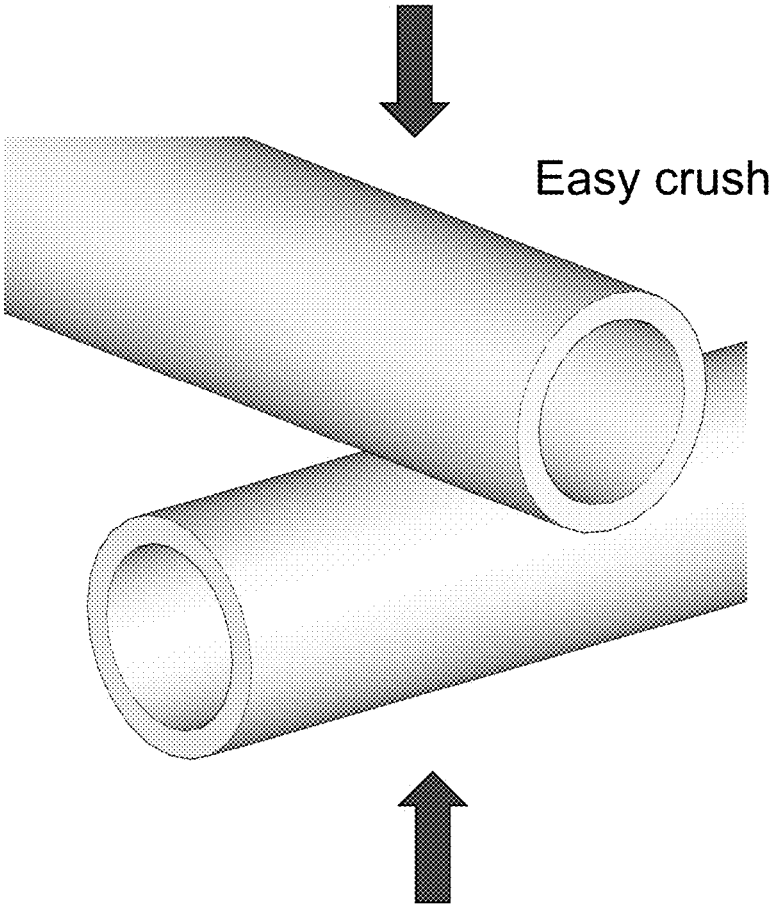
FIG. 6 is an overview appearance of a mutual binding between a warp yarns and a weft yarns in a plain weave structure.

Apart from the honeycomb weave structure, the inventor made a hollow yarn having a hollow ratio of 50% and studied about the use thereof. FIG. 3 is a schematic structural view of a hollow cotton yarn, having a hollow ratio of 50%. It should be noted that while the cotton yarn is hollow, the cotton fibers are not hollow. FIG. 4 is a cross-sectional view of a hollow cotton yarn, having a hollow ratio of 50%. For example, in a simple plain woven fabric structure, a towel is woven in a manner that warp yarns and weft yarns are crossed alternately up and down, and thus the warp yarns and the weft yarns are mutually constrained, i.e., the warp yarns bind the weft yarns and the vice versa. Consequently, if hollow yarns having the hollow ratio of 50% are used, a hollow structure thereof will be crushed, and thus a plain woven fabric structure cannot be maintained as well as features of hollow yarns cannot be maintained. FIG. 5 is an overview appearance of a plain weave structure. FIG. 6 is an overview appearance of a mutual binding between a warp yarns and a weft yarns in a plain weave structure. Therefore, it was essential for the inventor to study the use of hollow yarns having the hollow ratio of 50% while understanding features of a towel structure.

Figure 7:
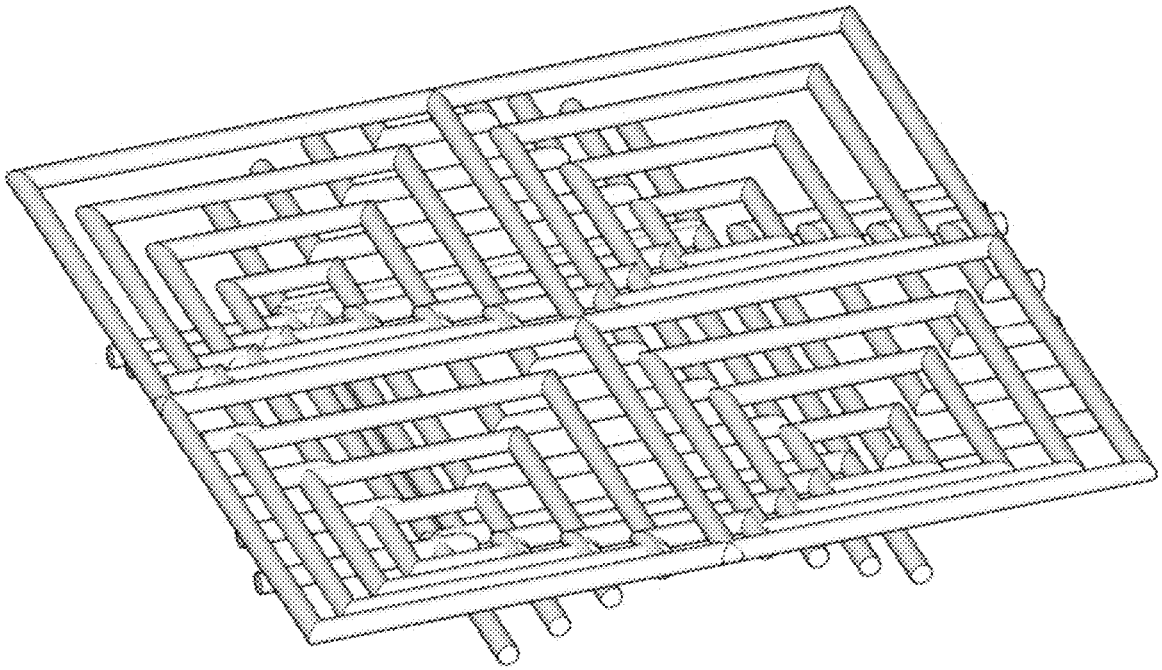
FIG. 7 is an overview appearance of a honeycomb weave structure.
Figure 8:
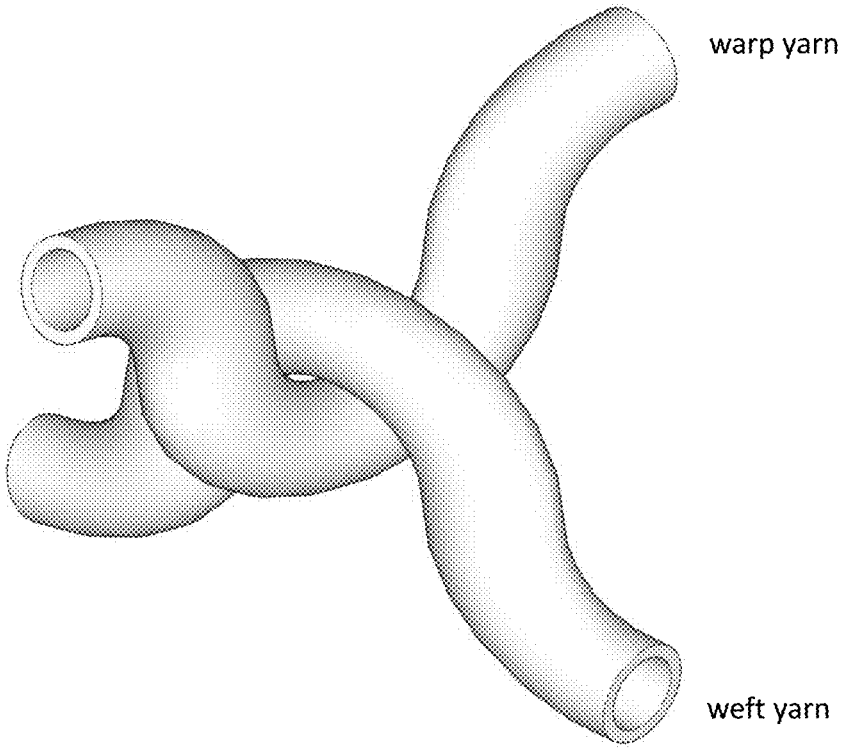
FIG. 8 is an overview appearance of a mutual binding between a warp yarns and a weft yarns in a honeycomb weave structure.

The inventor paid an attention to a fact that, in the honeycomb weave structure, the mutual binding between the warp yarns and the weft yarns is loose since the warp yarns and the weft yarns are shrunk. FIG. 7 is an overview appearance of a honeycomb weave structure. FIG. 8 is an overview appearance of a mutual binding between a warp yarns and a weft yarns in a honeycomb weave structure. Then, the inventor studied about application of the hollow yarns having the hollow ratio of 50%. Finally, the inventor achieved the present invention.

The inventor could conceived of the present invention on the basis of his knowledge about both of features of the honeycomb weave structure and features of the hollow yarns.

Generally, a hollow cotton yarn is formed by dissolving and removing water-soluble fibers (for example, water-soluble vinylon fibers) as a core. As the result, a hollow cotton yarn is entirely made of raw cotton fibers.

JP2002-030565 describes that a hollow structure of a hollow cotton yarn is easy to be crushed. The inventor of JP2002-030565 proposes the special and complicated chemical treatment so that a hollow structure is not crushed easily. But JP2002-030565 is silent about concrete degree of improvement and a hollow ratio thereof.

Meanwhile, a composite yarn made of cotton fibers and chemical fibers is proposed. Chemical fibers have strength and compensate for weakness of cotton fibers. As the result, a hollow composite yarn having high hollow ratio can be achieved, while maintaining strength.

Figure 9:
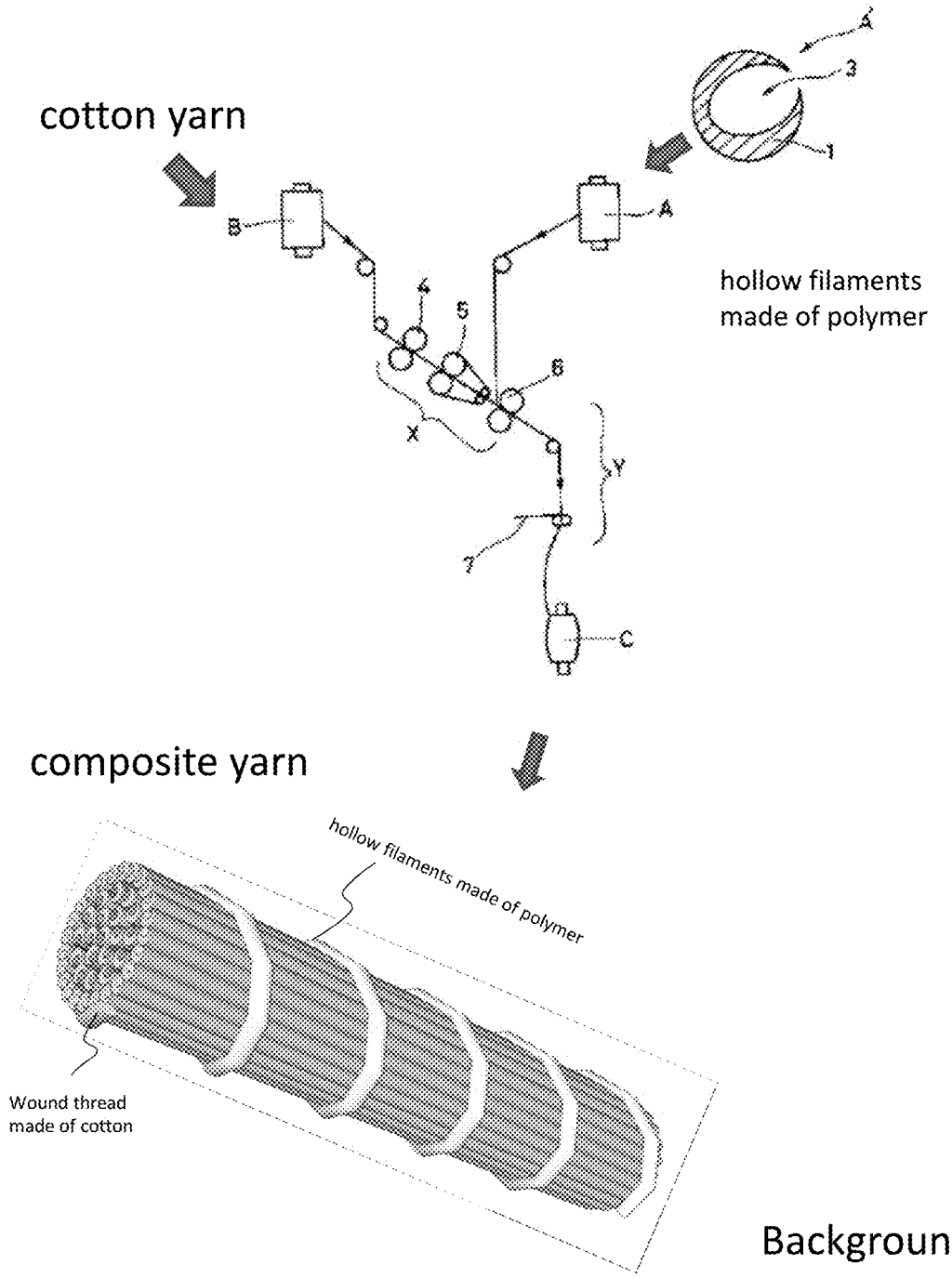
FIG. 9 shows background art.

JPH05-272026 and JPH07-097745 describe a hollow composite yarn which is formed of chemical hollow filaments wounded by cotton yarn. FIG. 9 shows background art.

Figure 10:
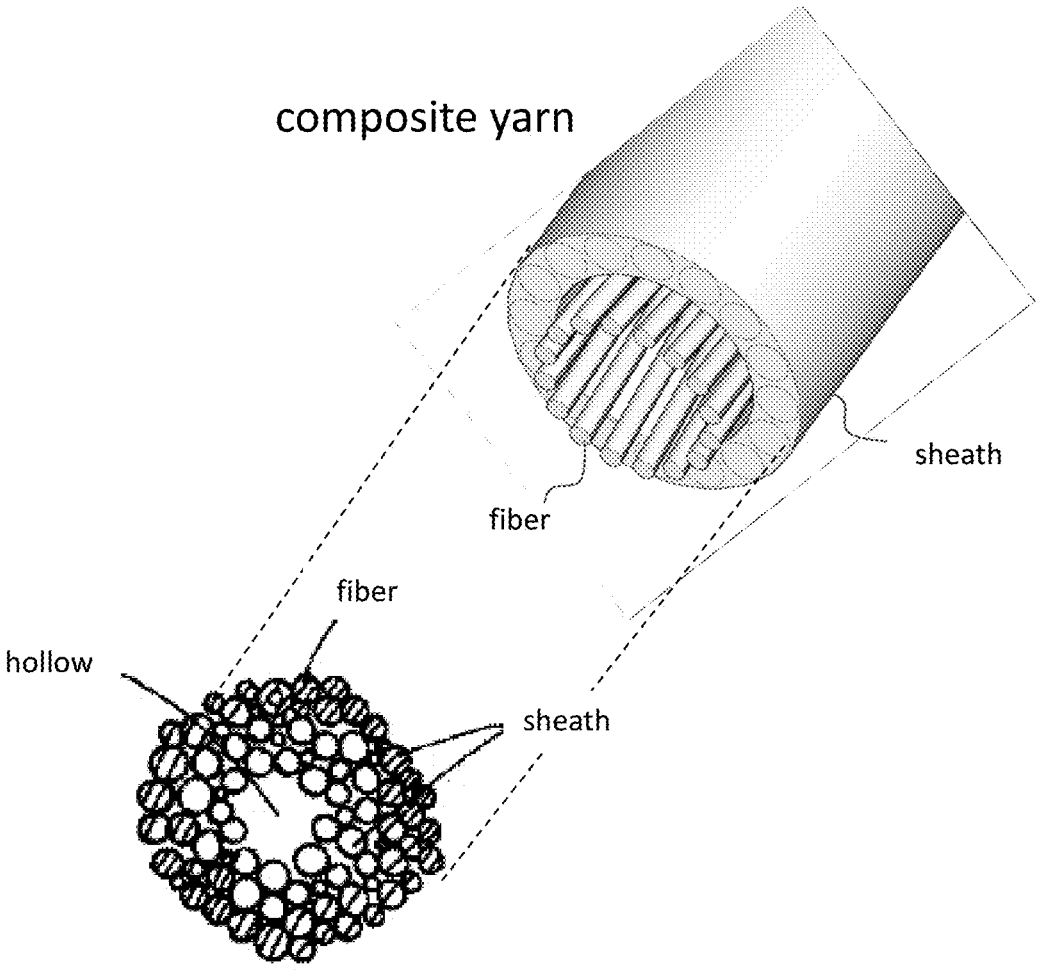
FIG. 10 shows background art.

JPH09-302545 describes a hollow composite yarn which is formed of hollow cotton yarn covered with a chemical sheath. FIG. 10 shows background art.

A hollow composite yarn can be applied to various usage, because it has enough strength. There is no motivation to search the use of hollow composite yarns having high hollow ratio, unlike present invention.

By the way, some people think that chemical substances may cause allergies. So a cotton yarn is more preferable for an everyday product like a towel than a composite yarn.

A cotton yarn is distinguished from a composite yarn clearly. A cotton yarn is interpreted to exclude chemical substances. In other words, a cotton yarn is entirely made of raw cotton fibers. This is generally well-known for a person in the art.

In the present towel, the hollow cotton yarn is entirely made of raw cotton fibers. Moreover, the honeycomb weave structure is entirely made of cotton yarns. So, honeycomb weave structure is entirely made of raw cotton fiber. As a result, the risk of allergy is remarkably low.

INDUSTRIAL APPLICABILITY

The present invention is specifically effective for the use of products such as towels, bath towels, and towel-made gowns. Further, the present invention is effective not only for towel products but also for materials of clothes such as room wears and pajamas and for materials of articles for infants.

The invention claimed is:

1. A towel product comprising:
a honeycomb weave structure;
wherein the towel product is woven only by hollow cotton yarns entirely made of raw cotton fibers;
wherein the honeycomb weave structure is entirely made of cotton yarns;
wherein the hollow cotton yarns have a hollow ratio of a range that is more than 42% and 60% or less; and
wherein each of the hollow cotton yarns is made by twisting fibers of raw cottons having an effective fiber length of a range between 25 mm and 42 mm;
wherein a hollow shape of said hollow cotton yarns is maintained by mutually restraining a warp yarn and a weft yarn.

2. The towel product according to claim 1, wherein the range of the hollow ratio of the hollow cotton yarns is between 42% and 50%.

3. The towel product according to claim 1, wherein each of the hollow cotton yarns is made by twisting fibers of raw cottons and a range of the effective fiber length of the raw cottons is between 25 mm and 37 mm.

4. The towel product according to claim 1, wherein the honeycomb weave structure includes warp yarns and weft yarns that are shrunk such that loose mutual binding is obtained.

5. A towel product comprising:
a honeycomb weave structure;
wherein the towel product is woven only by hollow cotton yarns entirely made of non-hollow, raw cotton fibers;
wherein the hollow cotton yarns have a hollow ratio of a range that is more than 42% and 60% or less; and
wherein each of the hollow cotton yarns is made by twisting fibers of raw cottons having an effective fiber length of a range between 25 mm and 42 mm;
wherein a hollow shape of said hollow cotton yarns is maintained by mutually restraining a warp yarn and a weft yarn.

6. The towel product according to claim 5, wherein the range of the hollow ratio of the hollow cotton yarns is between 42% and 50%.

7. The towel product according to claim 5, wherein each of the hollow cotton yarns is made by twisting fibers of raw cottons and a range of the effective fiber length of the raw cottons is between 25 mm and 37 mm.

8. The towel product according to claim 5, wherein the honeycomb weave structure includes warp yarns and weft yarns that are shrunk such that loose mutual binding is obtained.

* * * * *